United States Patent [19]

Mitter

[11] 4,089,193

[45] May 16, 1978

[54] MACHINE FOR PRINTING ON TEXTILE WEBS

[75] Inventor: Mathias Mitter, Verl-Sande-Mitte, Germany

[73] Assignee: Mitter & Co., Schloss Holte, Germany

[21] Appl. No.: 482,471

[22] Filed: Jun. 24, 1974

[30] Foreign Application Priority Data

Jun. 25, 1973 Germany ..... 2332153

[51] Int. Cl.[2] ..... F26B 13/18; F26B 13/30; B41F 23/04

[52] U.S. Cl. ..... 68/5 D; 34/155; 101/416 A

[58] Field of Search ..... 68/5 D; 101/219, 228, 101/416 A; 34/160, 155; 8/149.2; 226/95; 271/26, 112, 196, 197

[56] References Cited

U.S. PATENT DOCUMENTS

| | | | |
|---|---|---|---|
| 771,900 | 10/1904 | Finch | 101/228 |
| 1,115,808 | 11/1914 | Gessner | 34/160 |
| 1,251,173 | 12/1917 | Beregh, Jr. | 34/160 |
| 1,315,159 | 9/1919 | Rochon | 101/228 |
| 1,808,701 | 6/1931 | Wigglesworth | 68/5 D |
| 3,686,903 | 8/1972 | Fleissner | 68/5 D |
| 3,768,280 | 2/1971 | Kannegiesser et al. | 68/5 D |
| 3,779,047 | 12/1973 | Fleissner | 68/5 D |

*Primary Examiner*—Richard E. Aegerter
*Assistant Examiner*—Richard R. Stearns
*Attorney, Agent, or Firm*—Michael J. Striker

[57] ABSTRACT

A textile web is advanced in a path, and one or more printing stations print onto it. Downstream of the printing station or stations is provided a suction arrangement which contacts the advancing textile web from below, extending across the entire width of the web and exerting suction through the latter.

16 Claims, 8 Drawing Figures

2
21
242
142
42
4
40
41
34
32
33
31
30
3
1
K 44
41
34
240
40
140
242
242a 7
174
72
73
72a
70
74
F
75
L
42
T
A
71
40
73
W
2

84
83
40
42
8
80
81
82
2
P
M 7
73
74
174
72
75
70
D
KA
42
71'
40
73
2
KA

MACHINE FOR PRINTING ON TEXTILE WEBS

BACKGROUND OF THE INVENTION

The present invention relates generally to a machine for printing a textile web, and more particularly to a machine for printing onto a travelling textile web.

Printing machines of this type are well known in the art. Generally speaking, they are constructed as screen printing machines which may or may not have rotating printing screens, or else flat printing screens, and which are provided with squeegees which squeeze printing paste through the perforations of the printing screen. In this type of machine one side of the travelling textile web is printed. The web may travel continuously or intermittently, and the printing medium may be ink, or any other medium that is to be applied on to one side of the web.

If the web is a smooth textile, the printing presents no problem because the ink or printing medium will properly penetrate into the web. If, however, the web is of the type that has a nap, even a comparatively low one, substantial difficulties are observed, because the applied printing medium tends to remain located in the region of the tips of the nap and not to penetrate sufficiently through the nap and into the actual base textile. This means, of course, that the printed pattern or the like will rapidly wear away, and that it is impossible to produce a high-quality printed textile web.

SUMMARY OF THE INVENTION

It is, accordingly, a general object of the invention to overcome the disadvantages of the prior art.

More particularly, it is an object of the invention to provide an improved machine for printing on textile webs which is not possessed of the disadvantages that have been outlined above.

Still more particularly, it is an object of the present invention to provide such an improved printing machine wherein the depth of penetration of the printing medium into the textile web is substantially improved.

In keeping with these objects, and with others which will become apparent hereafter, one feature of the invention resides in a machine for printing on textile webs, having advancing means for advancing a textile web in a path, printing means for printing onto the advancing web, and suction means arranged below the advancing textile web downstream of the printing means and extending across the path. The suction means exerts suction through the textile web and supportingly engages the same from below.

This invention assures that the applied printing medium will properly penetrate into the textile web. The printing medium is first applied by the printing means and has sufficient time to become properly distributed on the textile web surface before the just-printed increment of the textile web reaches the suction means which then draws the printing medium into the structure of the textile web. This action of the suction means should be understood to take place without in any way causing a smearing or blurring of the contours or the pattern of the printed matter.

It is particularly advantageous if the suction means comprises a perforated drum which is rotatably mounted, and a stationary suction nozzle having a suction aperture which is covered by a similarly perforated plate which is contoured to correspond to a segment of a cylinder and which engages the inner circumferential surface of the drum. The web can then travel over the exterior circumferential surface of the drum and has suction applied to it as it passes over the region where the suction acts upon the perforate wall of the drum.

The web need of course not be advanced continuously, but can be made to travel discontinuously. If so, suction can be applied discontinuously also, in correspondence with the incremental advancement of the web over the drum. If the web advances continuously, then the suction can be applied continuously, or it can be applied discontinuously but at rapid intervals. This rapid discontinuous application of suction, a "pulsing effect", can of course also be applied if the web travels discontinuously.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
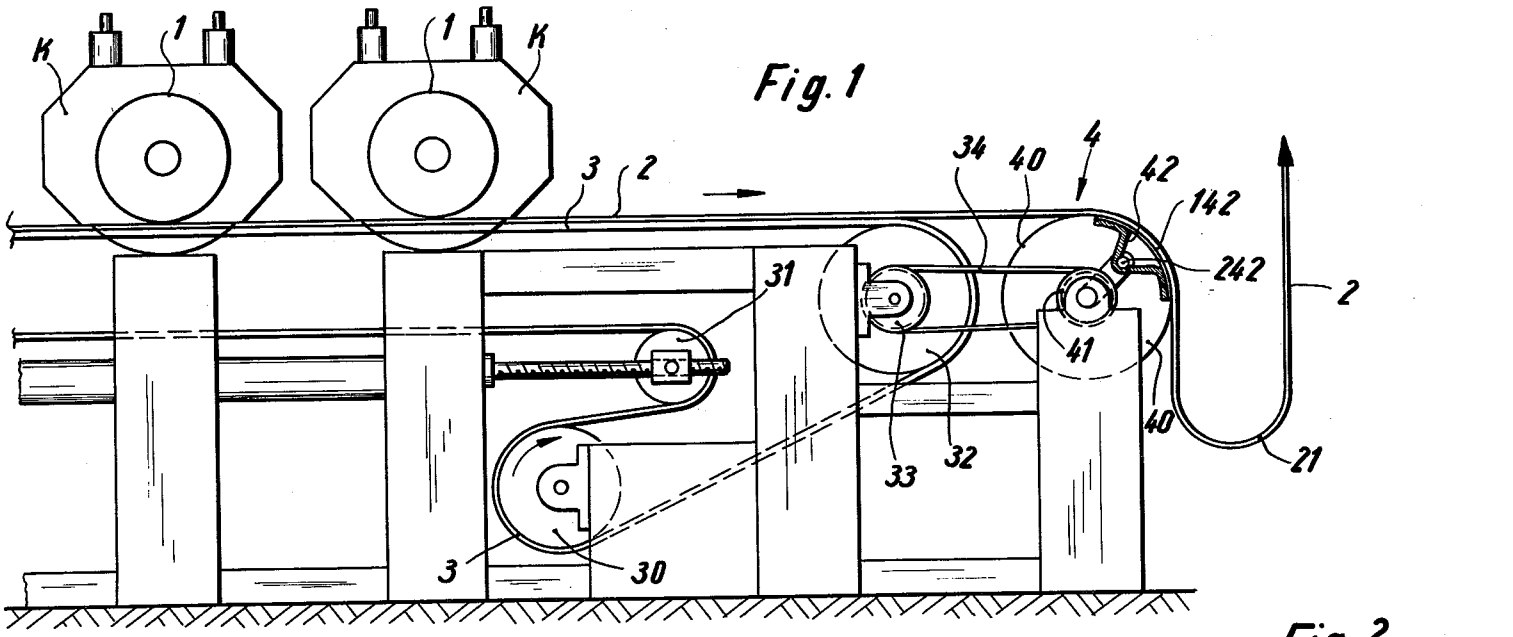
FIG. 1 is a fragmentary diagrammatic side view, illustrating an embodiment of the invention.
Figure 2:
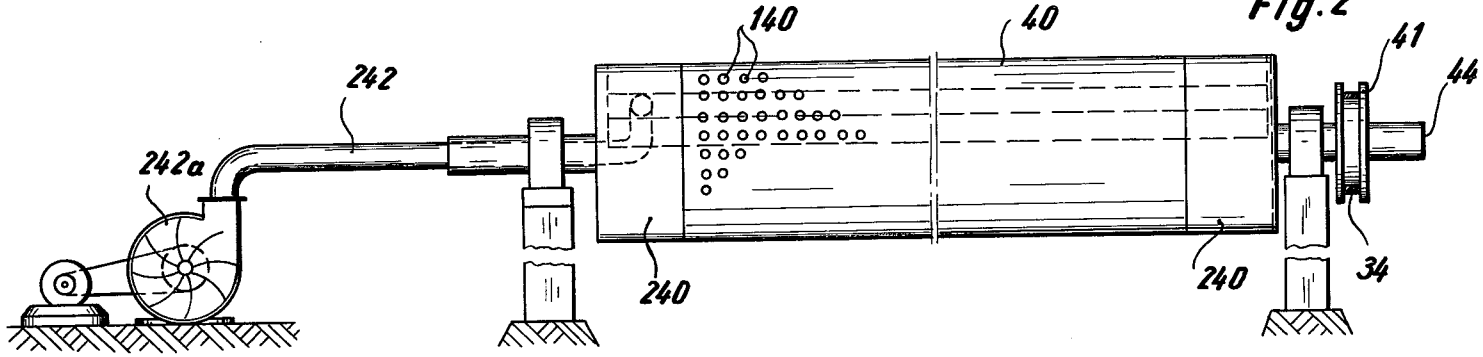
FIG. 2 is a view of FIG. 1, looking towards the left.

Referring now to the drawing in detail, and firstly to the embodiment in FIGS. 1–2 thereof, it will be seen that reference numeral 1 identifies printing units (there are two provided in this embodiment, but there could be one or more than two) which are part of the printing heads K. Details of the printing units need not be illustrated, because they are conventional and it is not important to discuss such details for the invention to be understood. It will suffice to point out that the printing units 1 might be conventional rotary-screen printing units. A web 2 of textile material travels through these printing units in the direction of the arrow shown in FIG. 1 and is supported by an endless printing blanket 3 or similar support, which is guided around a drive roller 30, a tension roller 31 and two reversing rollers 32 of which one is illustrated in the drawing.

Located downstream of the printing units 1, as seen with reference to the direction of travel of the web 2, is a suction arrangement 4 which extends over the entire width of the web 2. The suction arrangement includes a perforated drum 40 which is mounted for rotation on a shaft and is provided on the shaft with a pully 41. Another pully 33 is mounted on the shaft of the reversing roller 32 for the printing blanket 33, and a belt 34 transmits motion from the pully 33 to the pulley 41, so that the reversing roller 32 and the perforated drum 40 rotate in unison.

A stationary suction nozzle 42 extends through the hollow perforated drum 40 and is provided with a plate 142 that is configurated to resemble a segment of a cylinder. The plate 142 overlies the suction aperture of the nozzle 42 and is itself perforated. A suction conduit 242 extends over the entire axial length of the drum 40 and communicates with the ventillator **242*a* through which suction is applied via the conduit 242 to the nozzle 42**.

The perforations of the drum 40 are identified with reference numeral 140 in FIG. 2, and it will be appreciated that they can be smaller and much more closely spaced than has been illustrated by way of example in that Figure. The perforations are advantageously located only in the center portion of the drum 40, whereas the end portions 240 are imperforate so as not to lose any suction. The shaft of the drum 40, on which the pulley 41 is mounted, is identified with reference numeral 44 in FIG. 2.

It will be appreciated that after printing ink or the like has been applied to the travelling web 2 at the printing units 1, each newly-printed increment of the web 2 will reach the suction device 4 and travel over the same after it has first moved off the printing blanket 3 which is reversed around the roller 32. As each increment travels over the drum 40, the suction applied via the nozzle 42 draws the printing medium into the fabric of the textile web 2, assuring that strong penetration of the medium will be obtained even in the case of high-napped textile webs, for example carpets or the like. As a general rule it is possible not only to obtain penetration of the printing medium throughout the entire height of the nap, but also into the base fabric of the web.

Figure 3:
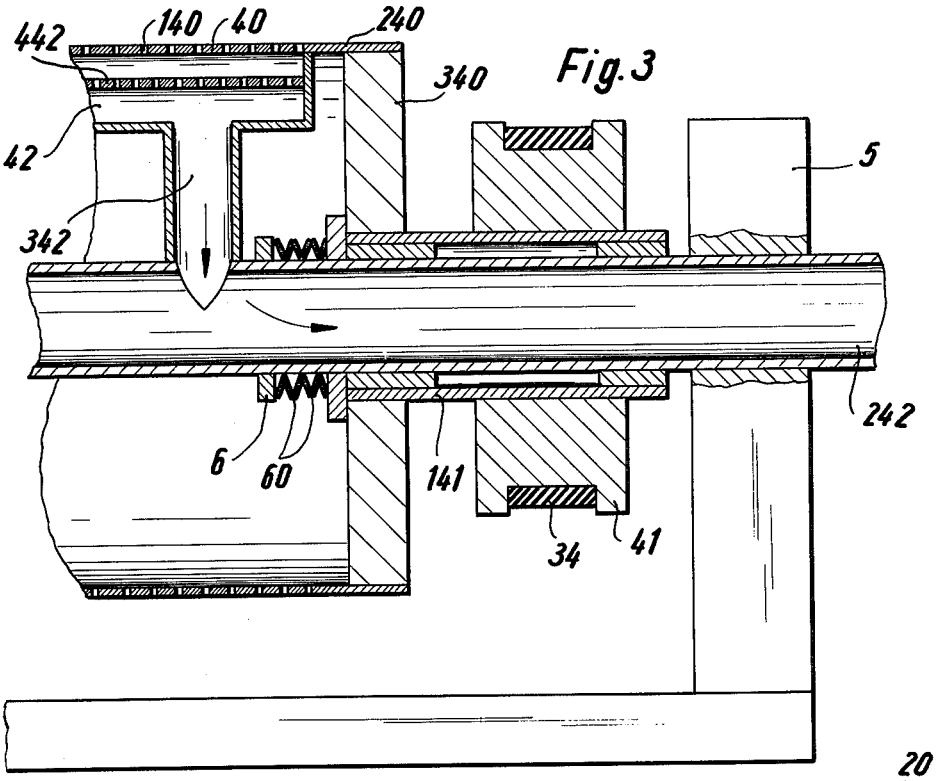
FIG. 3 is a fragmentary sectional detail view, illustrating a detail of FIG. 1 on an enlarged scale.

FIG. 3 shows an embodiment of the invention wherein the frame of the machine is diagrammatically shown and identified with reference numeral 5. It should be understood that this embodiment corresponds basically to that in FIGS. 1 and 2, but that it illustrates details of how the drum 40 can be mounted in the frame 5. Reference numeral 242 again identifies the suction conduit which is stationarily mounted in the frame 5 and which again is provided with the stationary suction nozzle 42 which has a plurality of suction tubes 342 (one shown) which are axially spaced and communicate the interior of the nozzle 42 with the interior of the conduit 242. To assure a more even distribution of suction over the perforations 140 of the drum 40, an insert 442 which is also perforated is inwardly speced from the wall of the drum 40; the perforations of the insert 442 preferably do not coincide with the perforations 140.

the imperforate end portions 240 (one shown in FIG. 3) each have inserted into them an imperforate end plate 340. The one that is illustrated in FIG. 3 is connected via a sleeve 141 that surrounds the conduit 242, with the pulley 41. A circlip or similar abutment element 6 is mounted on the conduit 242 inwardly spaced from the end plate 340, and springs (here dished springs 60) bear upon the circlip 6 and the end plate 340 to assure a smooth and quiet rotation of the drum 40 about the stationary suction nozzle 42. It is possible to provide printing ink collecting channels at the lower side of the conduit 242, in the event that printing ink should be drawn into the conduit 242. As a rule, however, the suction will be so adjusted that no printing ink is drawn in.

Figure 4:
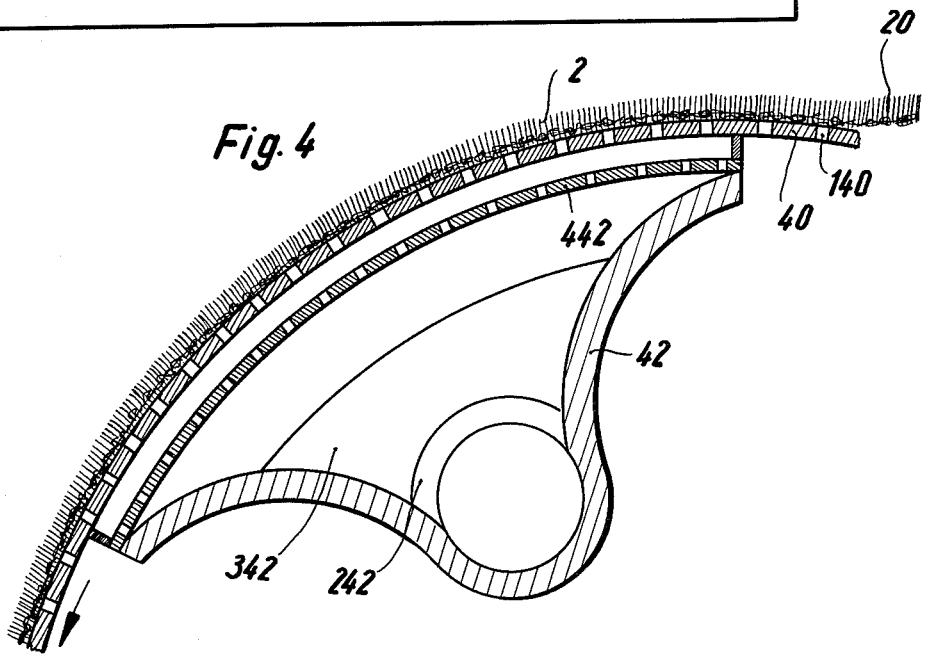
FIG. 4 is another fragmentary sectional detail view, illustrating a further detail of FIG. 1 on an enlarged scale.

FIG. 4 shows how the web 2 contacts with its base fabric 20 the perforated wall of the drum 40, preferably without being subjected to any tension. It is advantageous if the web is deflected through 90° as it travels around the drum 40, and if accordingly suction is applied over a similar 90° angle (compare also FIG. 1). For this purpose, i.e., to obtain this substantially 90° angle, it is advantageous — as also shown in FIG. 1 — to form the web 2 downstream of the drum 40 into a loop 21. It is of course also important that the suction arrangement is located downstream of the location where the web 2 becomes separated from the printing blanket 3, that is that the printing blanket 3 does not travel with the web around the drum 40.

Figure 5:
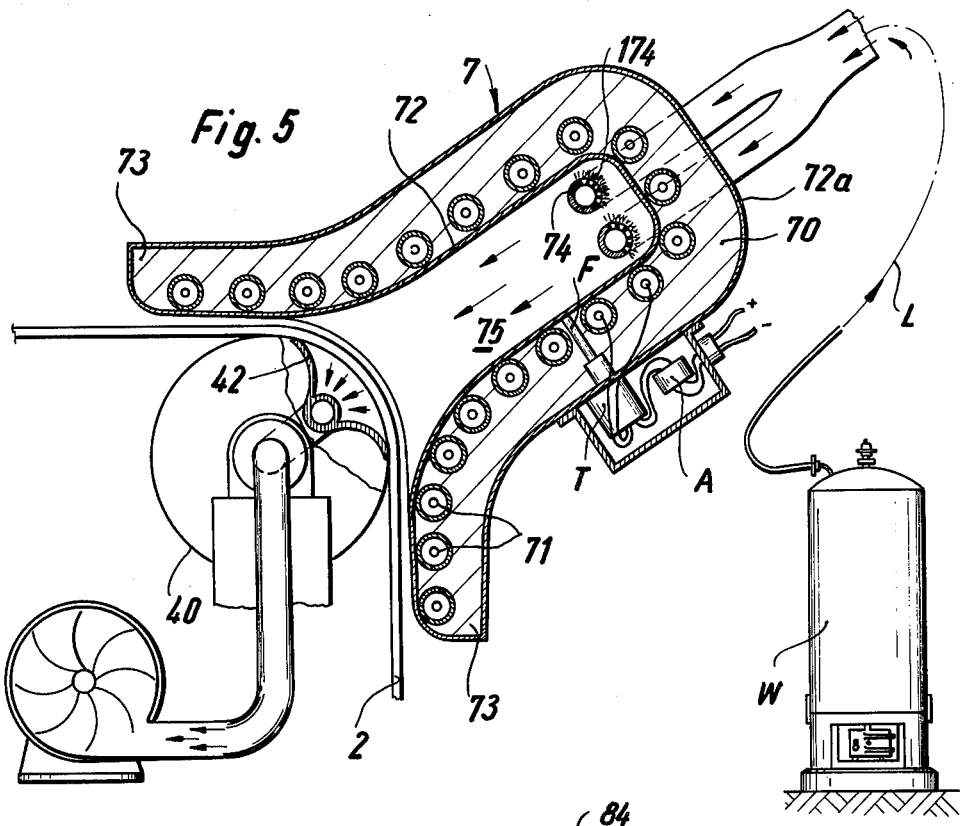
FIG. 5 is a fragmentary partly sectional detail view of a further embodiment of the invention.

FIG. 5 shows a further embodiment of the invention which improves the advantages obtained with the invention even more. In FIG. 5 the drum is again identified with reference numeral 40, and the web 2 travels over and around the drum 40. Located opposite the drum 40, so as to face that increment of the web 2 which travels around the drum, is a hood 7 of substantially bell-shaped cross-section which extends over the entire axial length of the drum 40 and is closed at its opposite axial ends (not illustrated). The open side of this hood 7 faces the drum 40 and is spaced from the web 2 by only a very small distance, amounting to only a few millimeters. The hood 7 has an inner wall 72 and an outer wall **72*a*. The interior space between these walls is filled with thermally insulating material 70, and located in it are heating devices, here illustrated as resistance heating rods 71 which are so positioned as to heat the inner wall 72. The hood 7 has skirt portions 73 which overlie parts of the web 2 as they approach the drum 40 and leave the same, respectively. This means that the approaching and leaving parts of the web are subject to heating by heat transmitted from the inner wall 72**.

Tubes 74 are arranged in the interior of the hood 7 and have outlet openings 174 which advantageously are directed against the inner wall 72. These tubes may be connected via a conduit L with a boiler W so that they are supplied with steam which issues through the openings 174. A thermostat T can be mounted on the outside of the hood 7 and be provided with a sensor f that senses the temperature of the inner wall 72; the thermostat T is connected via the connector A with a source of electrical energy, as are of course the heating rods 71. The temperature of the heating rods 71 may be automatically controlled by the thermostat T, which is connected with them as illustrated, in dependence upon temperture changes that are sensed by the sensor F. Having the openings 174 face away from the open end of the hood 7, has the advantage that the steam will be well distributed throughout the interior of the hood, and the purpose of heating the inner wall 72 is, of course, to prevent condensation of the steam on the inner wall 72.

When the steam is drawn by the suction of the nozzle 42 through the web 2, a certain amount of steam condensation takes place on and in the web, which tends to thin the printing ink or paste, thus facilitating a drawing-in of the thinned ink into the body of the web 2, and also improving the penetration of the ink into the individual fibers of the web 2.

A further advantage of this construction is the fact that the web 2 itself becomes warmed as the steam is drawn through it; this is advantageous because the web passes from the printing machine into a steaming device (not shown) wherein it is subjected to a steaming operation. Since the web is already prewarmed by the steam that is drawn out of the hood 7 and through the web by the suction nozzle 42, it will enter the steaming device at a temperature that is sufficiently high to prevent significant condensation of the steam in the steaming device on the web 2. As a general rule, the web in the prior-art arrangements enters at a temperature of approximately 20° C into the steam device, where it is abruptly heated to approximately 100°–104° C, so that steam condenses on the web with the danger that the condensation water might wash some of the newly applied ink or color off the tips of the nap, resulting in a significant decrease of the brilliance of the color or colors. This is avoided by the use of the hood 7, since as the steam is passed through the web as the latter travels beneath the open end of the hood 7, the web is heated to a temperature of approximately 60° C, so that the temperature differential between the temperature at which the web enters the subsequent steaming device and the temperature to which it is heated in the steaming device is now only approximately 40° C, causing a substantial reduction in the amount of condensation that will take place. Also, the passage of the steam through the web 2 on the drum 42 results in a type of "pre-fixing" of the ink or color on the web, which is evidently advantageous.

Figure 6:
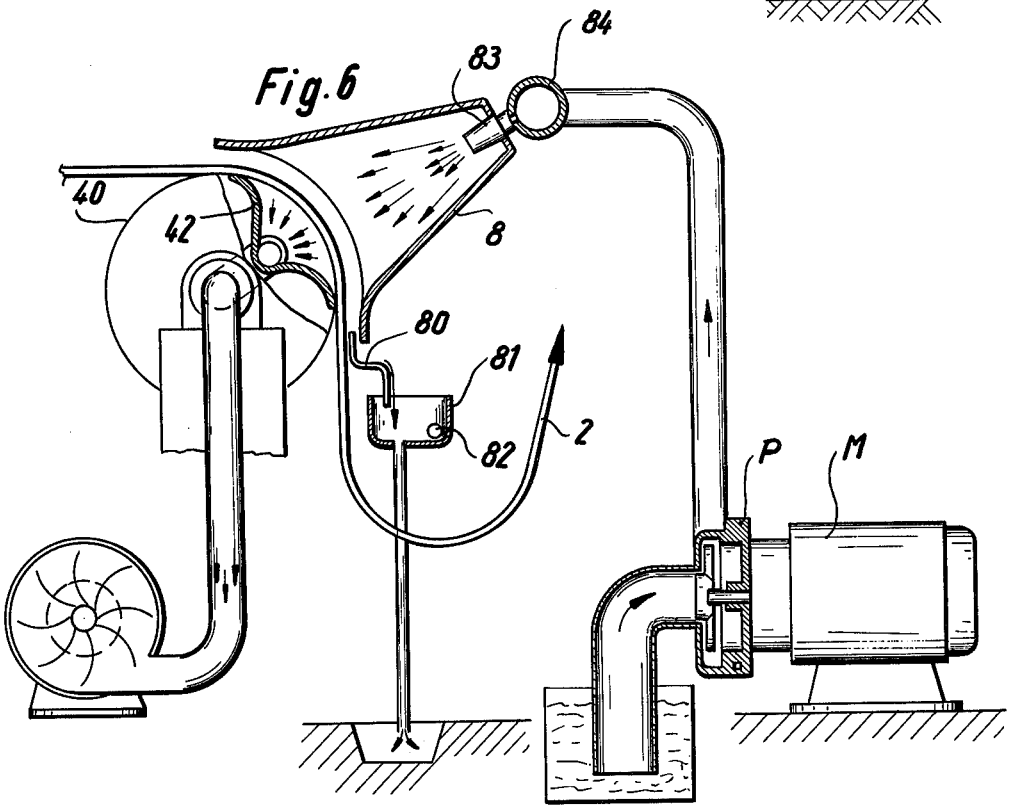
FIG. 6 is a view similar to FIG. 5, but illustrating a somewhat different embodiment.

The embodiment of FIG. 6 also uses a hood, which is identified with reference numeral 8. The hood 8 may be constructed analogously to the hood 7, in that it may be — but need not be — provided with the insulating material 70 and the heating rods 71. As a general rule, a simple hood of the type illustrated will be sufficient in the embodiment of FIG. 6, being arranged in the manner as shown and being provided with a lower marginal portion on which liquids — for instance chemicals that are sprayed from the nozzle 83 in the direction of the arrows and which serve to improve the penetration of the ink or color into the web 2, can run off onto a baffle 80 from which they in turn run off into a trough-shaped reservoir 81 having an outlet 82. The outlet 82 may be controlled by a valve or the like. Reference numeral 84 identifies a conduit through which the chemicals or other liquids are supplied to the nozzle 83 from a reservoir out of which they are drawn by a pump P which is driven by a motor M. The chemicals or other liquids need not serve to aid in the penetration of the ink into the web 2, but could also have the purpose of fixing the colors or the like. The spray of chemicals is drawn through the web 2 by the suction exerted by the nozzle 42, and the chemicals or other liquids can of course be sprayed hot or cold. The axial ends of the hood 8 are closed, just as is the case with the hood 7 in FIG. 5.

Figure 7:
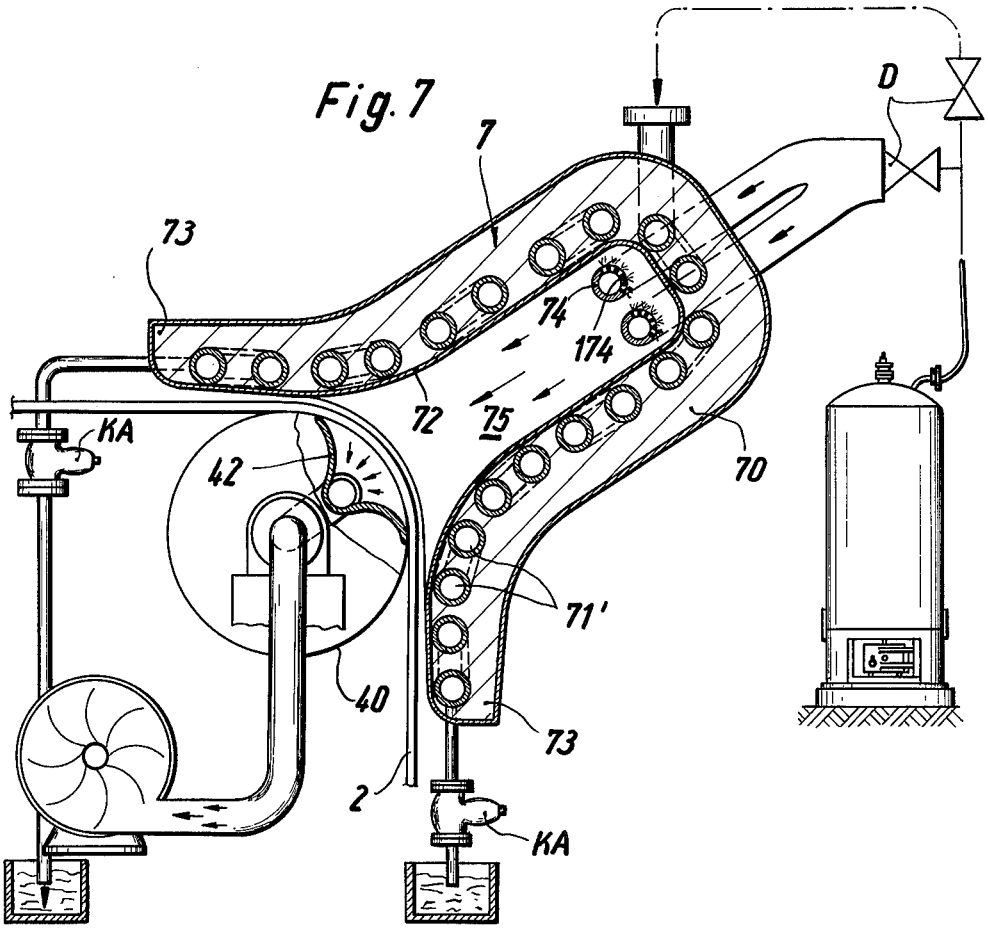
FIG. 7 is a view similar to FIG. 5, illustrating still another embodiment.

FIG. 7 shows another embodiment which is reminiscent of that in FIG. 5, and wherein like reference numerals identify like components. In FIG. 7, however, steam is supplied into the tubes 71' which are located in the hood 7 in place of the heating rods 71 of FIG. 5. The tubes 71' may be arranged in form of a single pipe having the tube convolutions 71', and at opposite ends of this pipe outlets for condensate may be provided, and condensate separators KA may be located. Throttle valves D control the flow of steam, which originates in the same boiler as in FIG. 5, to the conduits 71' as well as to the pipes 74.

Figure 8:
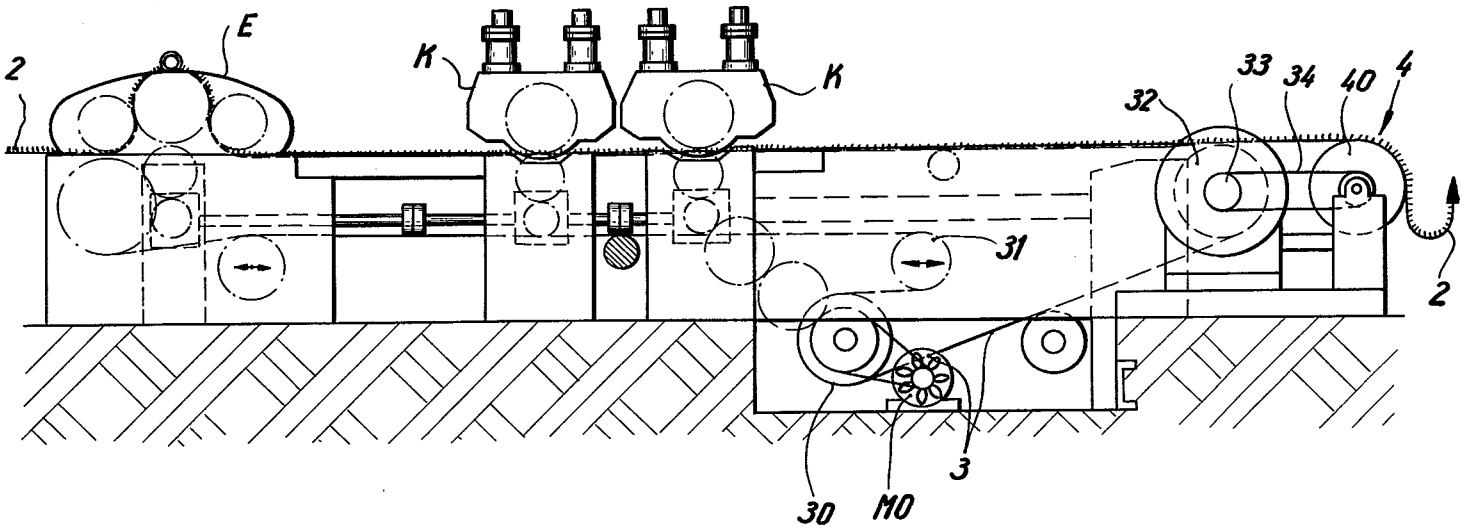
FIG. 8 is a diagrammatic side view illustrating the overall arrangement of the machine according to the present invention.

FIG. 8, finally, is a diagrammatic side view illustrating the overall arrangement of a machine according to the present invention. It will be seen that the printing blanket 3 is advanced by a motor MO which turns the driven roller 30. The printing blanket 3 in turn rotates the roller 32 by frictional engagement, and the roller 32 in turn rotates the drum 40 due to the connection via the belt 34, as was described earlier. Reference character E identifies the device at which the web 2 is admitted into the machine and which regulates the tension of the web 2 as it passes through the machine.

It will be understood that each of the elements described above, or two or more together, may also find a useful application in other types of constructions differing from the types described above.

While the invention has been illustrated and described as embodied in a machine for printing on textile webs, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a machine for printing on textile webs, a combination comprising advancing means for advancing a textile web in a path; printing means for printing onto the advancing web; suction means arranged below the advancing textile web downstream of said printing means comprising a turnably mounted hollow perforate drum, and a suction nozzle mounted in said drum having a nozzle aperture extending along an inner peripheral surface of said drum over a portion of arc, said suction means exerting suction through said textile web and supportingly engaging the same from below; a hood opposite said drum and having an open side facing the same so that said web must travel past said open side; and means for admitting treating fluid into said hood so that such fluid is drawn by said suction nozzle through said web.

2. A combination as defined in claim 1, wherein said means for admitting comprises outlet apertures in said hood which communicate with the interior thereof.

3. A combination as defined in claim 1, wherein said hood has an inner wall and an outer wall, insulating material between said walls, and heating elements between said walls for heating said inner wall.

4. A combination as defined in claim 1, wherein said hood extends over the axial length of said drum and has a pair of skirt portions which respectively project in direction upstream and downstream of said path over the travelling web.

5. A combination as defined in claim 4; and further comprising heating means in said skirt portions.

6. In a machine for printing on textile webs, a combination comprising advancing means for advancing a textile web in a path, including an endless printing blanket and upstream and downstream reversing rollers about which said printing blanket is trained; printing means between said reversing rollers for printing onto the advancing web; and suction means beyond said downstream reversing roller and comprising a hollow perforate drum rotatable about an axis tranverse to said path and positioned to be partially surrounded by the textile web after the same moves off said printing blanket in the region of said downstream reversing roller, and a suction outlet in said drum, said web travelling about said perforate drum in contact therewith and being deflected through substantially 90°, and said suction outlet having an aperture which applies suction to the region where said web is deflected.

7. A combination as defined in claim 6, wherein said drum has an outer peripheral surface and is positioned for said surface to be in contact with the advancing web.

8. A combination as defined in claim 6, wherein said suction outlet comprises a part-cylindrical nozzle portion which is perforate and which engages said inner peripheral surface of said drum; and wherein said suction means further comprises a suction conduit extending axially of said drum and communicating with said nozzle.

9. A combination as defined in claim 8; further comprising a pulley turnably journalled on said suction conduit, and a sleeve connected with said pulley and said drum so that the latter is rotated when rotary motion is transmitted to said pulley.

10. A combination as defined in claim 8, said drum having an axial endwall with which said sleeve is connected; further comprising an abutment mounted on said conduit within said drum axially spaced from said endwall; and expansion spring means bearing upon said abutment and said endwall, respectively.

11. A combination as defined in claim 8, said combnation including a machine frame; and wherein said conduit is mounted on said frame.

12. A combination as defined in claim 6, wherein said perforate drum has a center portion and a pair of axially spaced end portions; and wherein only said center portion is perforate.

13. A combination as defined in claim 6, wherein said suction outlet comprises an apertured distributor plate spaced from said aperture.

14. A combination as defined in claim 6; and further comprising a hood opposite said drum and having an open side facing the same so that the web must travel past said open side, and a closed side spaced from and opposite said open side, and spray nozzles for liquid at said closed side, said hood extending over the axial length of said drum.

15. A combination as defined in claim 14, wherein said hood comprises means in the region of said open side for channelling excess sprayed liquid; and further comprising a collecting trough, and a baffle which directs excess liquid from said means into said trough.

16. A combination as defined in claim 6, wherein said suction outlet comprises a suction nozzle mounted in said drum and having a surface which is provided with a nozzle aperture and which is part-cylindrically curved and juxtaposed with a correspondingly curved portion of the inner circumferential surface of said drum.

* * * * *